US010025245B2

(12) United States Patent
Mukoyama et al.

(10) Patent No.: US 10,025,245 B2
(45) Date of Patent: Jul. 17, 2018

(54) RESISTANCE HEATING ELEMENT, FIXING DEVICE, AND IMAGE FORMING APPARATUS

(71) Applicant: Konica Minolta, Inc., Tokyo (JP)

(72) Inventors: Izumi Mukoyama, Hino (JP); Eiichi Yoshida, Hino (JP); Susumu Sudo, Tokyo (JP); Akira Ohira, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 487 days.

(21) Appl. No.: 14/597,835

(22) Filed: Jan. 15, 2015

(65) Prior Publication Data

US 2015/0212467 A1 Jul. 30, 2015

(30) Foreign Application Priority Data

Jan. 27, 2014 (JP) ..... 2014-012752

(51) Int. Cl.
*G03G 15/20* (2006.01)
*H05B 3/00* (2006.01)
*H05B 3/14* (2006.01)

(52) U.S. Cl.
CPC ..... *G03G 15/2057* (2013.01); *H05B 3/0095* (2013.01); *H05B 3/148* (2013.01); *H05B 2203/013* (2013.01); *H05B 2203/017* (2013.01)

(58) Field of Classification Search
None
See application file for complete search history.

(56) References Cited

U.S. PATENT DOCUMENTS

2011/0293342 A1* 12/2011 Yoshida ..... G03G 15/2057 399/333
2011/0318077 A1 12/2011 Mukoyama et al.
2012/0051810 A1* 3/2012 Yoshida ..... G03G 15/2057 399/333
2013/0045034 A1* 2/2013 Yoshida ..... G03G 15/2057 399/333
2014/0079454 A1* 3/2014 Mukoyama ..... H05B 3/0095 399/329
2016/0091847 A1* 3/2016 Mukoyama ..... G03G 15/2057 399/329

FOREIGN PATENT DOCUMENTS

JP 2012-008299 A 1/2012
JP 2013037213 A * 2/2013

OTHER PUBLICATIONS

Notification of Reasons for Rejection; Application No. 2014-012752; dated Feb. 9, 2016; dated Jan. 29, 2016; Applied Provisions: Article 29(1), 29(2) and 36; total of 4 pages; English translation of Notification of Reasons for Rejection; total of 6 pages; Grand Total of 10 pages.

* cited by examiner

*Primary Examiner* — Joseph M Pelham
(74) *Attorney, Agent, or Firm* — Lucas & Mercanti, LLP

(57) ABSTRACT

A resistance heating element contains a heat-resistant resin and conductive stainless steel fiber coated with a film, and satisfies the following expression (1): $1 \leq (r1/r0) \leq 1.03$, where r0 represents the initial resistance value of the resistance heating element, and r1 represents the resistance value of the resistance heating element after allowed to stand at 30° C. and a relative humidity of 80% for one week.

11 Claims, 3 Drawing Sheets

RESISTANCE HEATING ELEMENT, FIXING DEVICE, AND IMAGE FORMING APPARATUS

The entire disclosure of Japanese Patent Application No. 2014-012752 filed on Jan. 27, 2014 including description, claims, drawings, and abstract are incorporated herein by reference in its entirety.

BACKGROUND OF THE INVENTION

Field of the Invention

The present invention relates to a resistance heating element, a fixing device, and an image forming apparatus.

Description of the Related Art

In many conventional image forming apparatuses such as copying machines and laser beam printers, unfixed toner images transferred onto image holding members such as plain paper sheets after toner development are heated and fixed in a contact manner by a heated roller method.

However, it is time-consuming to increase temperature to an image-fixable temperature by the heated roller method, and a large quantity of heat energy is also required. So as to shorten the time (warm-up time) between power activation and a copying start and save energy, a heated-film fixing method is often used these days.

In a fixing device (fixer) of a heated-film fixing type, a seamless fixing belt formed by stacking a release layer made of fluororesin or the like on the outer surface of a heat-resistant film made of polyimide or the like is used. In such a fixing device of a heated-film fixing type, a film is heated via a ceramic heater, for example, and a toner image is fixed onto the surface of the film. Therefore, the heat conductivity of the film is a critical aspect. However, if the fixing belt film is made thinner so as to improve heat conductivity, mechanical strength decreases, and high-speed rotation becomes difficult, causing a problem in forming high-quality images at high speed. Furthermore, a ceramic heater or the like is easily damaged.

So as to solve such problems, there is a recently suggested method of forming a resistance heating element on a fixing belt, directly heating the fixing belt by feeding power to the heating element, and fixing a toner image. An image forming apparatus implementing this method has a short warm-up time, and consumes less power than an image forming apparatus of a heated-film fixing type. Therefore, an image forming apparatus implementing this method excels as a heat fixing device in terms of energy saving and high-speed operation.

An example of a heating belt used in a fixing belt is disclosed in JP 2012-8299 A. According to JP 2012-8299 A, the heat-resistant resin used in the heating belt contains fibrous filler that satisfies specific requirements.

According to the technique disclosed in JP 2012-8299 A, the initial resistance value is sufficiently low, but there are cases where an increase is observed in resistance with time. If the resistance of a resistance heating element increases with time, unevenness in fixing due to defective toner fixing might be observed in a case where the resistance heating element is used in the fixing belt of an image forming apparatus.

SUMMARY OF THE INVENTION

In view of the above, an object of the present invention is to provide a resistance heating element that has a stable resistance value over a long period of time. Another object of the present invention is to provide an image forming apparatus that can reduce uneven fixing.

To achieve at least one of the abovementioned objects, according to an aspect, a resistance heating element reflecting one aspect of the present invention comprises a heat-resistant resin and conductive stainless steel fiber coated with a film, and satisfies the following expression (1):

$$1 \leq (r1/r0) \leq 1.03,$$

where r0 represents the initial resistance value of the resistance heating element, and r1 represents the resistance value of the resistance heating element after allowed to stand at 30° C. and a relative humidity of 80% for one week.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
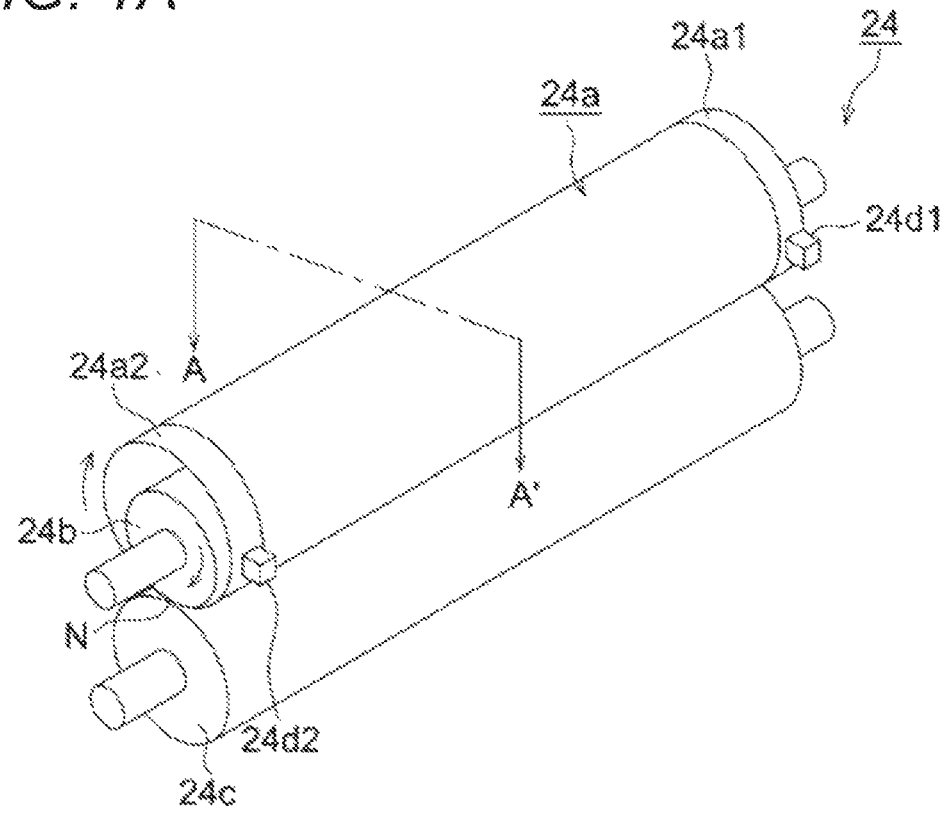
FIG. 1A is an enlarged schematic perspective view of a fixing device as an embodiment of the present invention.

Hereinafter, an embodiment of the present invention will be described with reference to the drawings. However, the scope of the invention is not limited to the illustrated examples.

A first embodiment of the present invention is a resistance heating element that contains a heat-resistant resin and conductive stainless steel fiber coated with a film, and characteristically satisfies the expression (1) shown below.

$$1 \leq (r1/r0) \leq 1.03 \qquad \text{Expression (1)}$$

r0: the initial resistance value of the resistance heating element r1: the resistance value of the resistance heating element after allowed to stand at 30° C. and a relative humidity of 80% for one week In JP 2012-8299 A, which has been described above, a system in which stainless steel fiber is dispersed as conductive filler in a heat-resistant resin is used in a heating belt for a fixing device. Stainless steel is normally considered to have a passive state film formed through air oxidation, and be relatively resistant to changes in external environments (heat or moisture). However, the inventors have discovered that a time-dependent resistance increase is observed in a system having stainless steel fiber dispersed as conductive filler in a heat-resistant resin, and such a resistance increase becomes particularly larger when a load (heat or moisture) is applied. Specifically, the increase in the resistance value after severe testing at high temperature and high humidity is particularly large, as in Comparative Example 1, which will be described later. Having searched for the cause of such a resistance increase, the inventors gather that even stainless steel fiber coated with a passive state film is oxidized by heat or moisture, and the resistance of the conductive material becomes higher. It is considered that, due to the oxidation, the number of free electrons that can move with respect to pure metal decreases, and the total resistance value increases. In view of this, the inventors assume that an oxidation preventing film formed on conductive stainless steel fiber can restrain external oxidation, and reduces time-dependent resistance.

The inventors also assume that the causes of a time-dependent increase in resistance in a system having stainless steel fiber dispersed as conductive filler in a heat-resistant resin are heat and moisture. In view of this, the inventors believe that the optimum criterion in determining whether the time-dependent resistance value is stabilized can be obtained by measuring the resistance value of such a system stored for a long period of time at high temperature and high humidity, or specifically, at 30° C. and a relative humidity of 80% for one week, and calculating the increase from the initial resistance value.

Where the ratio r1/r0 is 1.03 or lower, a resistance heating element that has a stable resistance value even when used over a long period of time can be obtained. It should be understood that the lower limit of r1/r0 is 1, which indicates that the resistance value after severe testing is the same as the initial value.

[Resistance Heating Element]

A resistance heating element contains a heat-resistant resin and conductive stainless steel fiber coated with a film. The stainless steel fiber is preferably dispersed in the resin. In the description below, the conductive stainless steel fiber coated with a film will be also referred to as the coated stainless steel fiber.

The heat-resistant resin is a resin that can maintain mechanical strength at high temperatures. The heat-resistant resin is preferably 200° C. or higher in deflection temperature under load, which is required under a load of 1.82 MPa, compliant with the testing method ASTM-D648 of American Society of Testing Materials.

Examples of such heat-resistant resins include polyphenylene sulfide (PPS), polyarylate (PAR), polysulfone (PSF), polyethersulfone (PES), polyetherimide (PEI), polyimide (PI), polyamideimide (PAI), polyetheretherketone (PEEK), and the like. In view of heat-resisting properties, a polyimide resin is preferable.

A polyimide resin can be obtained by heating polyamic acid as the precursor to 200° C. or higher, or by causing a dehydration/cyclization (imidization) reaction using a catalyst. Therefore, in a case where a polyimide resin is used as the heat-resistant resin, a mixture of polyamic acid and the coated stainless steel fiber is preferably heated to 200° C. or higher. The polyamic acid may be manufactured by dissolving tetracarboxylic dianhydride and a diamine compound in a solvent, and causing a polycondensation reaction through mixing and heating. Alternatively, a commercially available product may be used as the polyamic acid. The diamine compound and the tetracarboxylic dianhydride used here may be the compounds described in paragraphs [0123] to [0131] of JP 2013-25120 A.

The content of the heat-resistant resin in the resistance heating element is preferably 40 to 90 vol. % in the heating resistive element, from the viewpoint of formability and the like.

Examples of stainless steel that can be used in the coated stainless steel fiber include austenitic stainless steel, martensitic stainless steel, ferritic stainless steel, austenitic/ferritic stainless steel, precipitation-hardening-type stainless steel, and the like. Examples of austenitic stainless steel include SUS201, SUS202, SUS301, SUS302, SUS303, SUS304, SUS305, SUS316, and SUS317. Examples of austenitic/ferritic stainless steel include SUS329J1. Examples of martensitic stainless steel include SUS403 and SUS420. Examples of ferritic stainless steel include SUS405, SUS430, and SUS430LX. Examples of precipitation-hardening-type stainless steel include SUS630. Particularly, austenitic stainless steel and ferritic stainless steel are preferable, from the viewpoint of oxidation prevention.

In this specification, fiber is 0.25 or lower in the ratio (l/L) of the minor axis (the fiber cross-section diameter=the diameter in a case where the fiber cross section is circular, or the radius with the longest fiber cross-section diameter in the other cases: l) to the major axis (fiber length: L). The ratio (l/L) of the minor axis to the major axis is preferably 0.025 to 0.25. The minor axis of stainless steel fiber is preferably 0.5 to 30 μm, and more preferably, 1 to 10 μm. The length (major axis (fiber length: L)) of stainless steel fiber is preferably 5 to 1000 μm, and more preferably, 10 to 200 μm. The above mentioned major axis and minor axis of fiber are the average values of 500 samples of stainless steel fiber. Specifically, images of stainless steel fiber are captured at 500-fold magnification with the use of scanning electron micrograph, the minor axes and the major axes of 500 fiber samples are measured from images read with a scanner, and the average values of the minor axes and the major axes are calculated.

Stainless steel fiber is obtained by a conventionally-known manufacturing method. Specifically, coated stainless steel fiber of a desired diameter is obtained by stretching fiber pulled out of a nozzle if the thickness of the fiber needs to be further reduced (and heated if necessary), and the coated stainless steel fiber is then cut into pieces of a predetermined length. In this manner, stainless steel fiber can be obtained.

The conductive stainless steel fiber is coated with a film. The film is preferably an oxidation preventing film having an oxidation prevention function. Such a film is not particularly limited. However, so as to easily obtain a resistance heating element that satisfies the expression (1), the film is preferably made of at least one of oxides of Cr, Mo, Cu, and Si, or a composite oxide of these materials, and more preferably, is a chromium oxide film.

The oxidation preventing film may cover the entire stainless steel fiber or cover part of the stainless steel fiber, but preferably covers substantially the entire stainless steel fiber.

The method of forming the oxidation preventing film is not particularly limited, and may be (1) a method by which conductive stainless steel fiber is immersed in a solution containing an oxidation inhibitor for the stainless steel fiber, (2) a method by which conductive stainless steel fiber is heated at a low temperature in oxygen or a clean air, or (3) a method by which conductive stainless steel fiber is subjected to anodic polarization in a solution containing an oxidizer, for example. Particularly, the stainless steel fiber is preferably coated by the method (1), from the viewpoint of uniformity.

The oxidation inhibitor in the method (1) may be a conventional oxidizer, and specific examples include nitric acid, sulfuric acid, phosphoric acid, chromic acid, bichromic acid, and the like. As the stainless steel fiber is immersed in an oxidizing aqueous solution containing the above oxidizer, a material such as Cr, Mo, Cu, or Si in the stainless steel is oxidized, and a film of an oxide (or a composite oxide) of Cr, Ni, Ti, Mo, Al, Si, or the like can be generated.

The above methods (1) to (3) are used in passivation treatment for stainless steel, and accordingly, the above oxidation preventing film is preferably a film obtained by performing passivation treatment for stainless steel.

Although stainless steel has a passive state film without subjected to the passivation treatment, the resistance value of the resistance heating element is far outside the range defined by the expression (1) when the treatment is not performed as in Comparative Example 1, which will be described later.

The above coated stainless steel fiber preferably satisfies the expression (2) shown below.

$$1 \leq (rs1/rs0) \leq 10 \quad \text{Expression (2)}$$

rs0: the initial resistance value of the conductive material rs1: the resistance value of the conductive material after allowed to stand at 30° C. and a relative humidity of 80% for one week As the conductive material satisfies the above expression (2), increases in the resistance value of the conductive material are restrained at high temperature and high humidity, and accordingly, the resistance is stabilized even when used in a resistance heating element. In a case where the resistance value rs1 is invariable at the initial value rs0, the resistance value rs1 is lowest, and accordingly, the lower limit is expressed as rs1/rs0=1. So as to further stabilize changes in the resistance value over a long period of time, rs1/rs0 is preferably 5 or lower.

The resistance value of the conductive material is determined by a method described later in Examples.

So as to obtain appropriate strength, toughness, and conductive properties, the content of the coated stainless steel fiber in the resistance heating element is preferably 10 to 60 vol. %, and more preferably, 15 to 45 vol. % in the heating resistive element.

The resistance heating element may contain a conductive material other than the conductive stainless steel fiber coated with the above described oxidation preventing film, without departing from the scope of the invention. Examples of other conductive materials include pure metals such as gold, silver, iron, and aluminum, alloys, such as stainless steel (SUS) and nichrome, and nonmetals such as carbon and graphite. Example forms of the above conductive materials include spherical particles, particles of irregular shapes, flat particles, and fiber particles.

The resistance heating element of this embodiment satisfies the expression (1): $1 \leq (r1/r0) \leq 1.03$ (r0: the initial resistance value of the resistance heating element, r1: the resistance value of the resistance heating element after allowed to stand at 30° C. and a relative humidity of 80% for one week). The conditions of 30° C., the relative humidity of 80%, and one week are set for severe testing at high temperature and high humidity. If r1/r0 exceeds 1.03, the resistance value is not stabilized when the resistance heating element is used for a long period of time, and uneven fixing appears due to defective toner fixing when the resistance heating element is used for the fixing belt of an image forming apparatus. In a case where the resistance value r1 is invariable at the initial value r0, the resistance value r1 is lowest, and accordingly, the lower limit is expressed as r1/r0=1.

Here, the resistance value of the resistance heating element is determined by a method described later in Examples.

The volume resistivity ρv of the resistance heating element of this embodiment is preferably not lower than $0.08 \times 10^{-4}$ (Ω·cm) and not higher than $10 \times 10^{-4}$ (Ω·cm). As the volume resistivity of the resistance heating element is in the above range, the resistance heating element has appropriate conductive properties, and heat generation is efficiently performed. The volume resistivity is determined by applying a constant current I (A) to a cross-sectional area W×t, and measuring a potential difference V (V) between electrodes located at a distance L from each other: the volume resistivity ρv=VWt/IL.

The time-dependent resistance change rate (%) in electric heat generation by the resistance heating element of this embodiment (100×{(the time-dependent resistance value in electric heat generation/the initial resistance value)−1} is preferably 5% or lower. As the time-dependent resistance change rate is 5% or lower, the resistance value is stabilized when the resistance heating element is used over a long period of time, and uneven fixing due to defective toner fixing is reduced when the resistance heating element is used for the fixing belt of an image forming apparatus. The time-dependent resistance value in electric heat generation is the resistance value of the resistance heating element measured in a case where the resistance heating element is used as a seamless resin belt, electrodes are placed at both ends of the seamless resin belt, the temperature of the seamless resin belt is adjusted to 180° C. through electric heat generation caused by application of voltage between the electrodes, and a heat cycle test involving one-minute temperature adjustment and one-minute temperature non-adjustment is cyclically conducted 10,000 times. More preferably, the time-dependent resistance change rate (%) in electric heat generation by the resistance heating element is 3% or lower. The lower limit of the time-dependent resistance change rate (%) is 0, since a lower time-dependent resistance change rate (%) in electric heat generation by the resistance heating element is more preferable.

The thickness of the resistance heating element is preferably 10 to 150 μm, and more preferably, 20 to 100 μm.

[Fixing Device]

A second embodiment of the present invention is a fixing device that includes: a seamless resin belt; a fixing roller in contact with part of the inner peripheral surface formed inside the seamless resin belt; a pressure roller that presses the outer peripheral surface of the seamless resin belt toward the fixing roller; and a feeder that feeds power to the seamless resin belt. The seamless resin belt includes the resistance heating element of the first embodiment that is formed in an endless form. That is, the seamless resin belt in a fixing device of a third embodiment is the seamless resin belt of the second embodiment.

Figure 1B:
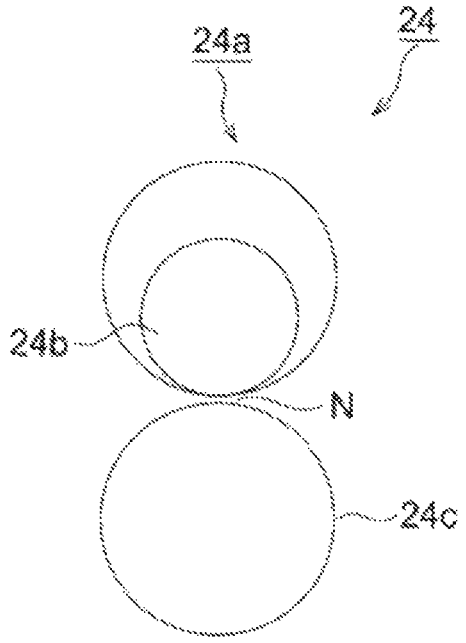
FIG. 1B is a schematic cross-sectional view of the fixing device, taken along the line A-A' defined in FIG. 1A.

FIGS. 1A and 1B are enlarged schematic views of a fixing device as an example of this embodiment. FIG. 1A is an enlarged schematic perspective view of the fixing device. FIG. 1B is a schematic cross-sectional view of the fixing device, taken along the line A-A' defined in FIG. 1A.

In the drawings, reference numeral 24 indicates the fixing device. The fixing device 24 includes a cylindrical heating belt (seamless resin belt) 24*a*, a fixing roller 24*b*, and a pressure roller 24*c* that rotates while pressing the cylindrical heating belt 24*a*.

The fixing roller 24*b* serves as the driving roller, and the cylindrical heating belt 24*a* rotates in the direction indicated by arrows in the drawing as the fixing roller 24*b* rotates (in the direction indicated by the arrows)

A fixing nip portion N is formed between the fixing roller 24*b* and the pressure roller 24*c* via the cylindrical heating belt 24*a*. A recording medium having a toner image (visible image) transferred thereto is nipped by the fixing nip portion N, and the toner image (visible image) is melted and fixed by the cylindrical heating belt 24*a*, to form the final image.

Reference numeral 24a1 indicates a feeding electrode provided at an end of the heating belt 24a, and reference numeral 24a2 indicates a feeding electrode provided at the other end of the heating belt 24a, the feeding electrode 24a1 and the feeding electrode 24a2 forming a pair.

Reference numeral 24d1 indicates a feeding member that is in contact with the feeding electrode 24a1 and feeds power to the heating belt 24a. Reference numeral 24d2 indicates a feeding member that is in contact with the feeding electrode 24a2 and feeds power to the heating belt 24a. With the temperature, fixing stability, and the like of the cylindrical heating belt 24a being taken into consideration, the position in which the feeding member is placed is a position in which the feeding electrode 24a1 is in contact with the fixing roller 24b, and the position is preferably in the vicinity of the fixing nip portion N, so as to stabilize the contact between the feeding electrode 24a1 and the feeding member 24d1.

The feeding members are preferably pressed against the feeding electrodes by pressing unit (such as springs), so as to be uniformly brought into contact with the feeding electrodes.

[Seamless Resin Belt (Heating Belt)]

Figure 2A:
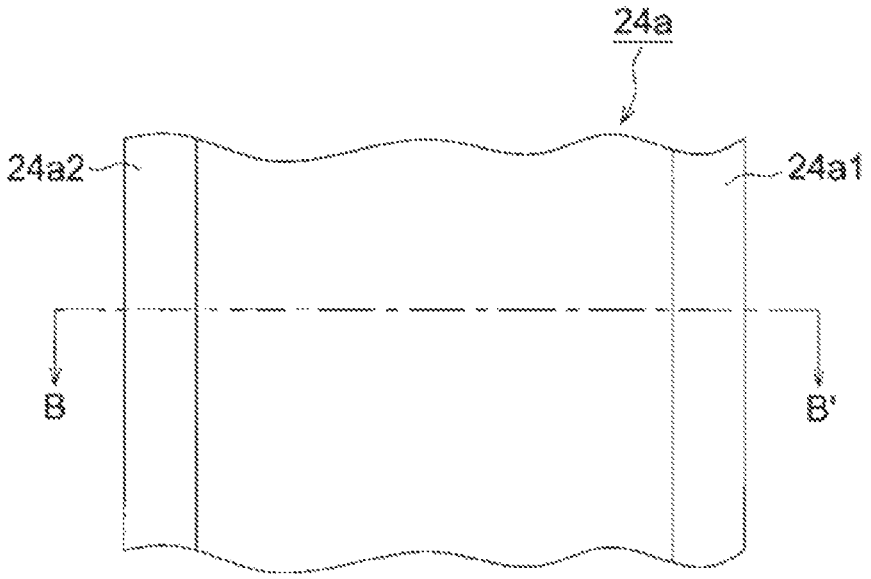
FIG. 2A is an enlarged schematic plan view of the heating belt shown in FIG. 1A.
Figure 2B:
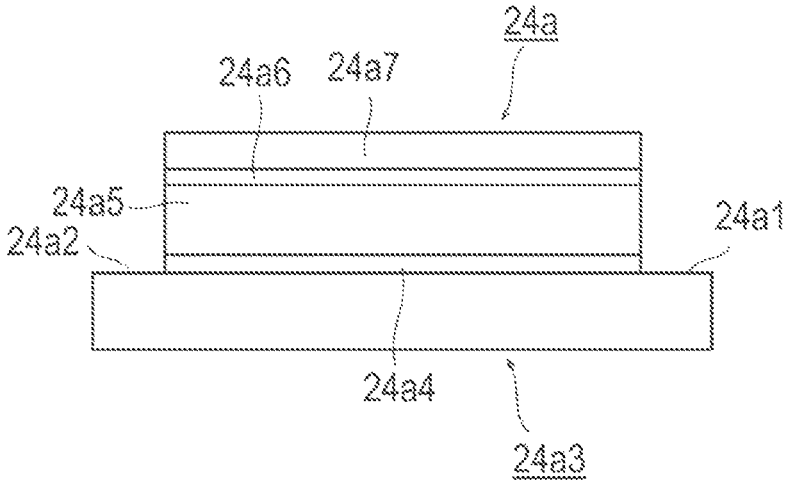
FIG. 2B is a schematic cross-sectional view of the heating belt, taken along the line B-B' defined in FIG. 2A.

FIG. 2A is an enlarged schematic plan view of the heating belt shown in FIG. 1A. FIG. 2B is an enlarged schematic cross-sectional view of the heating belt, taken along the line B-B' defined in FIG. 2A. The same components as those shown in FIGS. 1A and 1B are denoted by the same reference numerals as those used in FIGS. 1A and 1B.

In the drawings, reference numeral 24a indicates the cylindrical heating belt. The cylindrical heating belt 24a has a structure that includes a heating layer 24a3 having the feeding electrodes 24a1 and 24a2 at both ends, an elastic layer 24a5 formed on the heating layer 24a3 via an adhesive layer 24a4 except for the feeding electrodes 24a1 and 24a2, and a release layer 24a7 formed on the elastic layer 24a5 via an adhesive layer 24a6. The elastic layer 24a5 and the adhesive layers 24a4 and 24a6 can be formed as necessary.

In these drawings, the surface on the side of the heating layer 24a3 is in contact with the fixing roller 24b (see FIGS. 1A and 1B), and the surface of the release layer 24a7 is in contact with the pressure roller 24c (see FIGS. 1A and 1B).

The elastic layer 24a5 is a layer for transferring heat uniformly and flexibly to the toner image on the recording sheet. By virtue of the elastic layer, the toner image can be prevented from being pressed and damaged, and from being unevenly melted. Accordingly, generation of image noise can be prevented.

The material forming the elastic layer is not particularly limited, as long as the material has elasticity and high heat-resisting properties. Specific examples of materials that can form the elastic layer include silicone rubber, fluororubber, and the like. The silicone rubber contains siloxane bonds (—Si—O—Si) as the main chain, such as polyalkylalkenylsiloxane, polyalkylhydrogensiloxane, or fluorinated polysiloxane. Specific examples of the silicon rubber include dimethyl silicone rubber, fluorosilicone rubber, methylphenyl silicone rubber, methylvinyl silicone rubber, and the like. Examples of the fluororubber include vinylidene fluoride rubber, tetrafluoroethylene-propylene copolymeric rubber, tetrafluoroethylene-perfluoromethylvinylether copolymeric rubber, phosphazene fluororubber, fluoropolyether, and the like. It is possible to use one of these materials, or a combination of two or more of these materials. A commercially available product may be used as the silicone rubber, and it is possible to use a one-component, heat curable, transparent, low viscosity silicone adhesive, TSE3250 (a product name: Momentive Performance Materials Inc.) or the like. So as to achieve high heat-resisting properties, high resistance to low temperature, and a high degree of freedom at the time of processing, the elastic layer preferably contains silicone rubber.

So as to improve thermal conductivity, the elastic layer preferably contains inorganic particles. Examples of the inorganic particles that can be contained in the elastic layer include silicon carbide, boron nitride, alumina, aluminum nitride, potassium titanate, mica, silica, iron oxide, titanium oxide, talc, calcium carbonate, and the like.

The elastic layer may have a stack structure formed with two or more layers. The thickness (layer thickness) of the cylindrical elastic layer 24a5 is normally 0.1 to 30 mm, and more preferably, 0.1 to 20 mm, so as to save energy and provide the rubber with elasticity to secure a nip for a transfer sheet.

The elastic layer can contain various kinds of compounding agents such as an extender filler, a vulcanizing agent, a colorant, a heat-resisting agent, a pigment, or the like, in accordance with purposes of use and design.

The release layer 24a7 is a tube-like (cylindrical) layer for securing release characteristics for toner. The tube-like (cylindrical) release layer can be manufactured by extrusion molding or stretching molding.

The material forming the release layer should be able to secure release characteristics for toner, but is preferably a fluorine-based resin material, so as to achieve heat-resisting properties, wear and abrasion resistance, durability, mechanical strength, and the like. Specific examples of such fluorine-based resin materials include PTFE (polytetrafluoroethylene), PFA (a tetrafluoroethylene/perfluoroalkylvinyl ether copolymer), ETFE (an ethylene/tetrafluoroethylene copolymer), FEP (a tetrafluoroethylene-hexafluoropropylene copolymer), PCTFE (polychlorotrifluoroethylene), ECTFE (an ethylene-chlorotrifluoroethylene copolymer), and the like. It is possible to use one of these materials, or a combination of two or more of these materials. Of these materials, PFA (a tetrafluoroethylene/perfluoroalkylvinyl ether copolymer) is particularly preferable, from the viewpoint of formability and toner release characteristics. The release layer (fluorine-based resin tube) may be thermally shrinkable or unshrinkable. The fluorine-based resin tube to be used as the release layer may be a commercially available product, or may be specially manufactured. Examples of such specially-made materials include the HP series such as 451HP, 351HP, and 950HP (manufactured by Du Pont Kabushiki Kaisha), 802UP (manufactured by Asahi Glass Co., Ltd.), NST, NSE, SMT, SME, and GRC (manufactured by Gunze Limited), and the like.

The thickness (layer thickness) of the above described release layer (fluorine-based resin tube) is approximately 10 to 500 μm, and more preferably, 20 to 200 μm, and even more preferably, 20 to 50 μm, so as to save energy and secure sufficient strength and the like.

The inner diameter of the above release layer (fluorine-based resin tube) varies with the diameter of the substrate, but is preferably slightly smaller than the diameter of the substrate to the elastic layer. Specifically, the inner diameter of the release layer is normally 15 to 80 mm, and more preferably, 15 to 40 mm.

So as to improve adhesiveness between the heating layer 24a3 and the elastic layer 24a5, the adhesive layer 24a4 formed with a primer or an adhesive agent may be provided between the heating layer 24a3 and the elastic layer 24a5. In this case, the adhesive layer 24a4 is formed on (the surface of) the heating layer 24a3 by using a primer or an adhesive agent, and the elastic layer 24*a*5 is formed on the adhesive layer 24*a*4 by using liquid silicone rubber, fluororubber, or the like, which has not been subjected to vulcanization. Here, the adhesive agent is to bond the release layer and the elastic layer by virtue of an intermolecular force and an anchoring effect, and the primer is to bond the release agent and the elastic layer (with high wettability) by virtue of an intermolecular force and chemical binding.

Likewise, so as to improve adhesiveness between the elastic layer 24*a*5 and the release layer 24*a*7, the adhesive layer 24*a*6 formed with a primer or an adhesive agent may be provided between the elastic layer 24*a*5 and the release layer 24*a*7.

The formation of the feeding electrodes 24*a*1 and 24*a*2 is not particularly limited, and conduction tapes may be attached to the heating layer 24*a*3.

[Image Forming Apparatus]

A third embodiment of the present invention is an image forming apparatus that includes a fixing device that fixes an unfixed toner image formed on a transfer member by an electrophotographic method, to the transfer member with heat and pressure. The fixing device is characteristic of the third embodiment.

Figure 3:
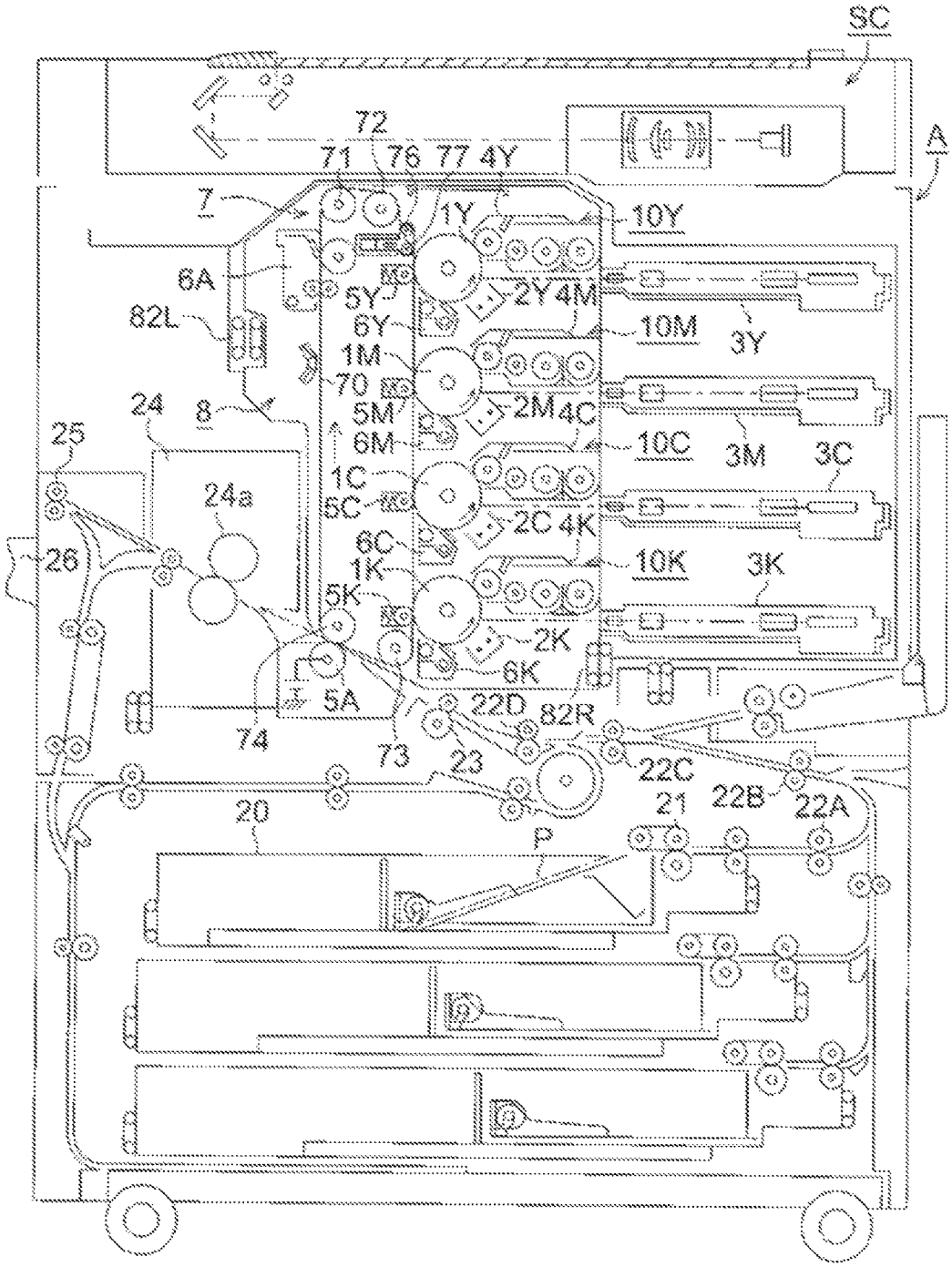
FIG. 3 is a schematic cross-sectional view of an example structure of an electrophotographic image forming apparatus.

FIG. 3 is a schematic cross-sectional view showing an example structure of the electrophotographic image forming apparatus. This drawing shows a full-color image forming apparatus.

In FIG. 3, reference numerals 1Y, 1M, 1C, and 1K indicate photosensitive members, reference numerals 4Y, 4M, 4C, and 4K indicate developing devices, reference numerals 5Y, 5M, 5C, and 5K indicate primary transfer rolls as a primary transfer unit, reference numeral 5A indicates a secondary transfer roll as a secondary transfer unit, reference numerals 6Y, 6M, 6C, and 6K indicate cleaning devices, reference numeral 7 indicates an intermediate transfer unit, reference numeral 24 indicates a heat-roll fixing device, reference numeral 70 indicates an intermediate transfer member.

This image forming apparatus is called a tandem-type color image forming apparatus, and includes: image forming units 10Y, 10M, 10C, and 10K, the endless-belt intermediate transfer unit 7 as the transfer unit, a sheet conveying unit 21 of an endless belt type that conveys an image holding member P, and the heat-roll fixing device 24 as the fixing unit. An original image reading device SC is placed on the main frame A of the image forming apparatus.

The image forming unit 10Y that forms a yellow image as one of toner images in different colors formed on the respective photosensitive members includes the drum-like photosensitive member 1Y, a charging unit 2Y placed around the photosensitive member 1Y, an exposing unit 3Y, the developing unit 4Y, the primary transfer roll 5Y as a primary transfer unit, and the cleaning unit 6Y. The image forming unit 10M that forms a magenta image as another one of the toner images in different colors includes the drum-like photosensitive member 1M, a charging unit 2M placed around the photosensitive member 1M, an exposing unit 3M, the developing unit 4M, the primary transfer roll 5M as a primary transfer unit, and the cleaning unit 6M.

The image forming unit 10C that forms a cyan image as yet another one of the toner images in different colors includes the drum-like photosensitive member 1C, a charging unit 2C placed around the photosensitive member 1C, an exposing unit 3C, the developing unit 4C, the primary transfer roll 5C as a primary transfer unit, and the cleaning unit 6C. The image forming unit 10K that forms a black image as still another one of the toner images in different colors includes the drum-like photosensitive member 1K, a charging unit 2K placed around the photosensitive member 1K, an exposing unit 3K, the developing unit 4K, the primary transfer roll 5K as a primary transfer unit, and the cleaning unit 6K.

The endless-belt intermediate transfer unit 7 includes the endless-belt intermediate transfer member 70 as a second image bearing member in the form of an intermediate transfer endless belt that is wound around the rolls and is rotatably supported.

The images in the respective colors formed by the image forming units 10Y, 10M, 10C, and 10K are sequentially transferred onto the rotating endless-belt intermediate transfer member 70 by the primary transfer rolls 5Y, 5M, 5C, and 5K, so that a combined color image is formed. The image holding member P such as a paper sheet serving as the transfer member housed in a sheet feeder cassette 20 is conveyed by the sheet conveying unit 21 to the secondary transfer roll 5A as the secondary transfer unit via intermediate rolls 22A, 22B, 22C, and 22D, and a resist roll 23, so that the color image is collectively transferred onto the image holding member P. The image holding member P having the color image transferred thereto is subjected to fixing treatment by the fixing device 24 with a heating belt, is nipped by discharge rolls 25, and is then placed onto a sheet discharge tray 26 located outside the apparatus.

Meanwhile, after the color image is transferred onto the image holding member P by the secondary transfer roll 5A, the endless-belt intermediate transfer member 70 from which the image holding member P has been removed by virtue of curvature is subjected to residual toner removal by a cleaning unit 6A.

During image formation, the primary transfer roll 5K is continuously pressed against the photosensitive member 1K. The other primary transfer rolls 5Y, 5M, and 5C are pressed against the photosensitive members 1Y, 1M, and 1C, respectively, only when color image formation is performed.

The secondary transfer roll 5A is designed to be pressed against the endless-belt intermediate transfer member 70 only when the image holding member P passes therethrough for secondary transfer.

A housing 8 can be pulled out of the apparatus main frame A via supporting rails 82L and 82R. The housing 8 houses the image forming units 10Y, 10M, 10C, and 10K, and the endless-belt intermediate transfer unit 7.

The image forming units 10Y, 10M, 10C, and 10K are arranged in a row in the vertical direction. The endless-belt intermediate transfer unit 7 is placed on the left side of the photosensitive members 1Y, 1M, 1C, and 1K in the drawing. The endless-belt intermediate transfer unit 7 includes the rotatable endless-belt intermediate transfer member 70 that is wound around rollers 71, 72, 73, 74, 76, and 77, the primary transfer rolls 5Y, 5M, 5C, and 5K, and the cleaning unit 6A.

As the housing 8 is pulled out of main frame A, the image forming units 10Y, 10M, 10C, and 10K, and the endless-belt intermediate transfer unit 7 are integrally pulled out of the main frame A.

As described above, toner images are formed on the photosensitive members 1Y, 1M, 1C, and 1K through charging, exposure, and development, the toner images in the respective colors are superimposed on one another on the endless-belt intermediate transfer member 70, the combined toner images are collectively transferred onto the image holding member P, and are pressed, heated, and fixed by the fixing device 24. After the toner images are transferred onto the image holding member P, the toner remaining on the photosensitive members 1Y, 1M, 1C, and 1K is removed by the cleaning device 6A at the time of the transfer, and the next image formation is performed through another cycle of charging, exposure, and development.

The photosensitive members are not particularly limited, and may be inorganic or organic photosensitive members.

The image holding member (also called a recording material, recording paper, a recoding paper sheet, or the like) may be a generally used one, and is not particularly limited, as long as it can hold a toner image formed by the above described image forming apparatus according to a known image forming method, for example. Examples of image holding members that can be used here include coated paper sheets such as plain paper, wood free paper, art paper, and coated paper, commercially available Japanese paper and postcard paper, plastic film for OHP, fabric, and the like.

[Method of Manufacturing a Resistance Heating Element]

An example of a manufacturing method to be implemented in a case where a resistance heating element containing polyimide as a preferred heat-resistant resin and coated stainless steel fiber is used as the heating layer of a fixing belt is now described.

The method of manufacturing the heating layer includes the step of preparing the coated stainless steel fiber, the step of preparing a solution doped with polyamic acid, an application/drying step, and an imidization reaction step.

(the Step of Preparing the Coated Stainless Steel Fiber)

As described above, the coated stainless steel fiber is preferably obtained by immersing conductive stainless steel fiber in a solution containing an oxidation inhibitor for stainless steel fiber. The oxidation inhibitor may be a conventional oxidizer, and specific examples include nitric acid, sulfuric acid, phosphoric acid, chromic acid, bichromic acid, and the like.

After the immersion, the stainless steel fiber is preferably washed and dried.

(Step of Preparing a Solution Doped with Polyamic Acid)

This is the step of dispersing the coated stainless steel fiber in polyamic acid.

The solution doped with polyamic acid may be prepared by adding the coated stainless steel fiber to a polyamic acid solution, mixing the coated stainless steel fiber and the polyamic acid solution while heating and stirring, and forming a polyamic acid solution containing the coated stainless steel fiber dispersed therein, or may be prepared by dispersing the coated stainless steel fiber in a solvent, dissolving tetracarboxylic dianhydride and a diamine compound as the materials for the polyamic acid in the dispersion solution, and then causing a polycondensation reaction through mixing and heating.

The above solvent (or the solvent of the polyamic acid solution) is a good solvent of polyamic acid (a solvent in which polyamic acid can be uniformly dissolved at a density of 20 mass % or higher at 25° C.), and examples of such good solvents are polar organic solvents including: amides such as N,N-dimethylacetamide, N,N-diethylacetamide, N,N-dimethylformamide, N,N-diethylformamide, N-methyl-2-pyrrolidone, and hexamethylsulforamide; sulfoxides such as dimethylsulfoxide and diethylsulfoxide; sulfones such as dimethylsulfone and diethylsulfone. It is possible to use one of these materials, or a combination of two or more of these materials.

The polyamic acid solution may be a commercially available one, or U-varnish S-301 (manufactured by Ube Industries, Ltd.).

The method of dispersing the coated stainless steel fiber may be a known method, and examples of such methods include mixing/stirring methods using various kinds of mixers, such as an ultrasonic dispersion method, high-pressure colliding dispersion method, a high-speed rotating dispersion method, a bead mill method, a high-speed shearing dispersion method, and a rotation/revolution dispersion method.

When the coated stainless steel fiber is dispersed, a nonionic polymer may be added thereto, so as to further improve dispersion stability of the coated stainless steel fiber. Examples of nonionic polymers include poly(N-vinyl-2-pyrrolidone), poly(N,N'-diethyl acrylazide), poly(N-vinylformamide), poly(N-vinylacetamide), poly(N-vinylphthalamide), poly(N-vinylsuccinic amide), poly(N-vinylurea), poly(N-vinylpiperidone), poly(N-vinylcaprolactam), poly(N-vinyloxazoline), and the like, and one or more of these nonionic polymers can be added. Of these nonionic polymers, poly(N-vinyl-2-pyrrolidone) is preferably added, so as to further improve dispersion properties of the coated stainless steel fiber.

(Application/Drying Step)

The obtained solution doped with polyamic acid is then applied to a metal mold and is dried, to remove the solvent. The method of application is not particularly limited, and it is possible to use a film thinning unit such as a bar coater, a doctor blade, a slide hopper, spray coating, spiral application, or T-shaped die extrusion.

The drying temperature for vaporizing the solvent is lower than the imidization starting temperature described later, and is not particularly limited as long as the solvent can be vaporized. Specifically, the drying temperature is 40 to 280° C., and more preferably, 60 to 150° C., for example. At this point, the solvent might remain in the film, and there is no problem as long as the residual solvent does not flow even when the surface of the coated film (the film coated with the polyamic acid having the coated stainless steel fiber dispersed therein) for forming the heating fixing belt is tilted. The drying time is appropriately set so as to remove an appropriate amount of the solvent.

(Imidization Reaction Step)

This imidization reaction step is the step of forming a heating layer of a polyimide resin by imidizing the polyamic acid through calcination at a specific calcination temperature for a predetermined period of time.

The specific calcination temperature for an imidization reaction is the imidization starting temperature, and is normally 200° C. or higher, and more preferably, 280 to 500° C. The calcination time is normally ten minutes or longer, and more preferably, 20 to 240 minutes.

The heating belt is manufactured by forming, as appropriate, the elastic layer and the release layer on the heating layer formed in the above manner. For example, the elastic layer is formed by applying an elastic layer forming liquid onto the heating layer but not on the feeding electrodes and then drying the liquid. It is preferable to form the elastic layer after forming a primer layer to improve adhesion between the elastic layer and the heating layer. The release layer is then formed by applying a release layer forming liquid on the elastic layer but not on the feeding electrodes, and then drying the liquid. It is preferable to form the release layer after forming a primer layer to improve adhesion between the elastic layer and the release layer. After that, the cylindrical metal mold is pulled out, and the cylindrical heating fixing belt formed by sequentially stacking the heating layer containing the coated stainless steel fiber, the elastic layer, and the release layer is completed.

Alternatively, a metal mold having a heating layer formed on a resin tube may be inserted, and a release layer forming liquid may be injected between the heating layer and the resin tube, to form the release layer. At this point, primer layers for improving adhesion may be formed between the respective layers.

The feeding electrodes 24*a*1 and 24*a*2 can be formed by attaching conductive tapes to both ends of the heating layer with a tape attaching machine after the formation of the release layer.

EXAMPLES

The advantageous effects of the present invention are now described through an Example and Comparative Examples. In Example and Comparative Examples, "parts" and "%" represent "parts by weight" and "wt. %", respectively, unless otherwise noted. Also, each operation was performed at room temperature (25° C.), unless specifically stated. It should be understood that the present invention is not limited to Example described below.

[Manufacture of Planar Heating Elements]

Example 1

After oil was removed with acetone from the surface of stainless steel fiber (steel type: SUS430, diameter: 8 μm, length: 35 μm, aspect ratio (diameter/length): 0.229), the stainless steel fiber was immersed in a 25 mass % nitric acid solution for one hour. After the immersion, the stainless steel fiber was washed with distilled water and was dried for two hours, to obtain conductive stainless steel fiber coated with a film.

A mixture of 20 g of the obtained stainless steel fiber and 100 g of a polyamic acid solution (U-varnish S-301 manufactured by Ube Industries, Ltd., solvent: N-methyl-2-pyrrolidone) as the precursor of a polyimide resin was prepared, and was stirred and defoamed with a rotation/revolution disperser. In this manner, a solution doped with polyamic acid was prepared.

The prepared doped solution was applied cylindrically onto a metal mold by spiral application so as to form a 100-μm thick calcined film. After 60-minute drying at 120° C., calcination was performed at 450° C. for 20 minutes, to forma cylindrical planar heating element. The content of the coated stainless steel fiber in the planar heating element was 15 vol. %.

Comparative Example 1

A planar heating element was obtained in the same manner as in Example 1, except that stainless steel fiber (steel type: SUS430, diameter: 8 μm, length: 35 μm, aspect ratio (diameter/length): 0.229) not coated with a film was used in place of the coated stainless steel fiber.

Comparative Example 2

After oil was removed with acetone from the surface of stainless steel fiber (steel type: SUS430, diameter: 8 μm, length: 35 μm, aspect ratio (diameter/length): 0.229), the stainless steel fiber was immersed in an antirust solution containing 90 mass % or more of zinc (product name: Noxudol, manufactured by Soshin Co., Ltd.) for one minute. After the immersion, the stainless steel fiber was washed with distilled water and was dried for one day, to obtain stainless steel fiber coated with zinc.

A planar heating element was obtained in the same manner as in Example 1, except that the stainless steel fiber coated with zinc was used in place of the coated stainless steel fiber manufactured in Example 1.

Comparative Example 3

After oil was removed with acetone from the surface of stainless steel fiber (steel type: SUS430, diameter: 8 μm, length: 35 μm, aspect ratio (diameter/length): 0.229), the stainless steel fiber was immersed in a resin-coat-type antirust agent (product name: New Peel PN-1, manufactured by Neos Company Limited) for one minute. After the immersion, the stainless steel fiber was washed with distilled water and was dried for one day, to obtain stainless steel fiber coated with resin.

A planar heating element was obtained in the same manner as in Example 1, except that the stainless steel fiber coated with resin was used in place of the coated stainless steel fiber manufactured in Example 1.

Comparative Example 4

After oil was removed with acetone from the surface of stainless steel fiber (steel type: SUS430, diameter: 8 μm, length: 35 μm, aspect ratio (diameter/length): 0.229), the stainless steel fiber was immersed in an antirust agent containing SUS powder and resin (product name: FC-113 (stainless color coat), manufactured by Fine Chemical Japan Co., Ltd.) for one minute. After the immersion, the stainless steel fiber was washed with distilled water and was dried for one day, to obtain stainless steel fiber coated with SUS.

A planar heating element was obtained in the same manner as in Example 1, except that the stainless steel fiber coated with SUS was used in place of the coated stainless steel fiber manufactured in Example 1.

[Measurement of Resistance Values of (Coated) Stainless Steel Fibers and Resistance Heating Elements]

The manufactured cylindrical planar heating elements were allowed to stand at 30° C. and a relative humidity of 80% for one week. After that, the resistance values (r1) were determined, and the ratios (r1/r0) of the resistance values (r1) to the initial resistance values (r0) were measured. The resistance value (Ω) in 300 mm of each fiber was measured with a resistance tester (Loresta-GP, manufactured by Mitsubishi Chemical Analytech Co., Ltd.).

Also, the coated stainless steel fibers (or the stainless steel fibers) used in Example and Comparative Examples were allowed to stand at 30° C. and a relative humidity of 80% for one week. After that, the resistance values (rs1) were determined, and the ratios (rs1/rs0) of the resistance values (rs1) to the initial resistance values (rs0) were measured. The resistance value (Ω) in 10 mm of each fiber was measured with a resistance tester (Loresta-GP, manufactured by Mitsubishi Chemical Analytech Co., Ltd.).

The results are shown in Table 1.

[Manufacture of Seamless Resin Belts]

A primer (KE-1880, manufactured by Shin-Etsu Chemical Co., Ltd.) was applied to each of the planar heating elements obtained in Example 1 and Comparative Examples 1 to 4, and was dried at ordinary temperature for 30 minutes. Each of the above planar heating elements was inserted into a fluororesin tube (GRC, manufactured by Gunze Limited) having a primer (XP-A6361, manufactured by Momentive Performance Materials Inc.) applied to the inside thereof.

After that, silicone rubber (XE15-C2038, manufactured by Momentive Performance Materials Inc.) was injected between the polyimide resin tube and the fluororesin tube. Primary vulcanization was then performed at 150° C. for 30 minutes, and secondary vulcanization was further performed at 200° C. for four hours, to obtain a tube having a 200-μm thick silicone rubber layer formed on the outer layer of the polyimide resin tube.

After cooling, the tube was removed from the metal mold. One loop of a conductive tape of 10 mm in width and 2 mm in thickness (CU-35C, manufactured by 3M Company) was attached to the circumferential surface at either end, to form the feeding electrodes. In this manner, each fixing belt was obtained.

[Volume Resistivities of the Resistance Heating Elements]

The electrode portions were formed with the conductive tape at either end portion of each fixing belt in the circumferential direction, and the resistance value at either end portion was measured. The volume resistivity of each resistance heating element was then calculated according to the equation shown below. Since the components of each fixing belt other than the heating belt are insulators, the volume resistivity of each resistance heating element can be determined through the above measurement.

$$\text{Volume resistivity } (\rho) = \times(R \cdot d \cdot W)/L(\Omega \cdot \text{cm})$$

(where R (Ω) represents the resistance value between both ends, d (cm) represents the thickness of the heating layer, W (cm) represents the length in the circumferential direction, and L (cm) represents the length between the electrodes.

The measurement of the resistance values (Ω) was conducted with a resistance tester (Loresta-GP, manufactured by Mitsubishi Chemical Analytech Co., Ltd.).

The results are shown in Table 1.

[Time-Dependent Resistance (R) Change Rates]

Voltage was applied between the electrodes of each seamless resin belt, to adjust the temperature of each seamless resin belt to 180° C. through electric heat generation. A heat cycle test involving one-minute temperature adjustment and one-minute temperature non-adjustment was cyclically conducted 10,000 times, and the resistance change rate with respect to the initial resistance of each resistance heating element was measured. This resistance measurement was conducted in the same manner as the above described measurement of the resistance of each resistance heating element.

[Evaluations on Unevenness in Fixing]

After the same heat cycle test as the above described heat cycle test was conducted on each of the seamless resin belts, each of the seamless resin belts was mounted on a fixing device having the structure shown in FIGS. 1A and 1B, the heating belt was incorporated into an image forming apparatus having the structure shown in FIG. 3, 500,000 image holding sheets of A4 size were fed into the image forming apparatus, with a 5-minute intermission being taken every time 10,000 sheets were fed into the image forming apparatus. Unevenness in image fixing (portions with defective toner fixing) was evaluated in accordance with the evaluation criteria shown below.

"low": the maximum length of an unevenly fixed portion is 1 mm or less.

"high": the maximum length of an unevenly fixed portion is greater than 1 mm.

The results are shown in Table 1.

TABLE 1

| | Materials in resistance heating element | | | Results | | | | |
|---|---|---|---|---|---|---|---|---|
| | | | | Resistance (R) change rate (r1/r0) in | | Volume resistivity | Time-dependent resistance (R) change rate in | Unevenness in fixing |
| | Resin | Conductive filler | Oxidation preventing film | resistance heating element | Resistance change (rs1/rs0) in filler | (Ω · cm) of resistance heating element | resistance heating element | in image forming apparatus |
| Example 1 | polyimide | stainless steel fiber | chromium oxide film | r1/r0 = 1.03 | 1 ≤ (rs1/rs0) ≤ 10 | $1.0 \times 10^{-5}$ | R ≤ 5% | low |
| Comparative Example 1 | polyimide | stainless steel fiber | N/A | r1/r0 = 1.1 | (rs1/rs0) = 1000 | $1.0 \times 10^{-5}$ | R > 10% | high |
| Comparative Example 2 | polyimide | stainless steel fiber | zinc film | r1/r0 = 1.06 | (rs1/rs0) = 700 | $1.0 \times 10^{-5}$ | R > 10% | high |
| Comparative Example 3 | polyimide | stainless steel fiber | resin film | r1/r0 = 1.04 | (rs1/rs0) = 100 | $1.0 \times 10^{-5}$ | 5% < R ≤ 10% | high |
| Comparative Example 4 | polyimide | stainless steel fiber | (SUS powder + resin) film | r1/r0 = 1.05 | (rs1/rs0) = 200 | $1.0 \times 10^{-5}$ | 5% < R ≤ 10% | high |

It is apparent from the results shown in Table 1 that the resistance value of the resistance heating element of the present invention is stable over a long period of time. Accordingly, uneven fixing due to defective toner fixing is reduced even when the resistance heating element is used for the fixing belt of an image forming apparatus.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A resistance heating element comprising a heat-resistant resin and conductive stainless steel fiber coated with a film, the resistance heating element satisfying the following expression (1):

$$1 \leq (r1/r0) \leq 1.03,$$

where r0 represents an initial resistance value of the resistance heating element, and r1 represents a resistance value of the resistance heating element after being subjected to test conditions in which the resistance heating element is allowed to stand at 30° C. and a relative humidity of 80% for one week, wherein the initial resistance value is measured upon manufacture of the resistance heating element and before being subjected to the test conditions.

2. The resistance heating element according to claim 1, wherein the conductive stainless steel fiber satisfies the following expression (2):

$1 \leq (rs1/rs0) \leq 10$, where rs0 represents an initial resistance value of the conductive stainless steel fiber, and rs1 represents a resistance value of the conductive stainless steel fiber after being subjected to the test conditions in which the resistance heating element is allowed to stand at 30° C. and a relative humidity of 80% for one week, wherein the initial resistance value is measured upon manufacture of the resistance heating element and before being subjected to the test conditions.

3. The resistance heating element according to claim 1, which contains 10 to 60 vol. % of the conductive stainless steel fiber.

4. The resistance heating element according to claim 1, wherein a volume resistivity of the resistance heating element is not lower than $0.08 \times 10^{-4}$ (Ω·cm) and not higher than $10 \times 10^{-4}$ (Ω·cm).

5. The resistance heating element according to claim 1, wherein a time-dependent resistance change rate in electric heat generation is 5% or lower.

6. The resistance heating element according to claim 1, wherein the conductive stainless steel fiber has a coating film, the coating film being a film made of at least one of oxides of Cr, Mo, Cu, and Si, or a composite oxide of Cr, Mo, Cu, and Si.

7. The resistance heating element according to claim 1, wherein the conductive stainless steel fiber has a coating film, the coating film being a chromium oxide film.

8. The resistance heating element according to claim 1, wherein a ratio (I/L) of a minor axis (I) of the conductive stainless steel fiber to a major axis (L) of the conductive stainless steel fiber is 0.25 or lower.

9. The resistance heating element according to claim 1, wherein a ratio (I/L) of a minor axis (I) of the conductive stainless steel fiber to a major axis (L) of the conductive stainless steel fiber is 0.025 to 0.25.

10. A fixing device comprising:

a seamless resin belt;

a fixing roller in contact with part of an inner peripheral surface formed inside the seamless resin belt;

a pressure roller configured to press an outer peripheral surface of the seamless resin belt toward the fixing roller; and a feeder configured to feed power to the seamless resin belt, wherein the seamless resin belt includes the resistance heating element of claim 1 in an endless form.

11. An image forming apparatus comprising a fixing device configured to fix an unfixed toner image to a transfer member with heat and pressure, the unfixed toner being formed on the transfer member by an electrophotographic method, wherein the fixing device is the fixing device of claim 10.

* * * * *